US006588915B1

(12) United States Patent
Chen

(10) Patent No.: US 6,588,915 B1
(45) Date of Patent: Jul. 8, 2003

(54) HANGING DEVICE

(76) Inventor: Chia-Teh Chen, 5F, No. 30, Yet Sen Rd., Taipei (TW)

( * ) Notice: Subject to any disclaimer, the term of this patent is extended or adjusted under 35 U.S.C. 154(b) by 0 days.

(21) Appl. No.: 10/051,151

(22) Filed: Jan. 22, 2002

(51) Int. Cl.[7] ..... F21V 33/00
(52) U.S. Cl. ..... 362/132; 362/260; 362/276
(58) Field of Search ..... 362/132, 133, 362/134, 147, 260, 276

(56) References Cited

U.S. PATENT DOCUMENTS 4,246,629 A * 1/1981 Marrero ..... 362/147
4,420,798 A * 12/1983 Herst et al. ..... 362/147
5,450,299 A * 9/1995 Lepre ..... 362/145
5,453,917 A * 9/1995 Ogawa ..... 362/222

* cited by examiner

*Primary Examiner*—Sandra O'Shea
*Assistant Examiner*—Guiyoung Lee
(74) *Attorney, Agent, or Firm*—Rosenberg, Klein & Lee

(57) ABSTRACT

A hanging device comprises a support member, two fixtures, two adjustment units and a hanging rod. The hanging rod includes a cover and a lampshade that enclose a fluorescent tube and the support member. The adjustment units are detachably engaged with the lampshade for easily replacing the fluorescent tube. More than one of the hanging devices can be electrically connected in series by providing each hanging device with a socket and an electrical plug on ends thereof.

10 Claims, 13 Drawing Sheets

HANGING DEVICE

BACKGROUND OF THE INVENTION

1. Field of the Invention

The invention relates to a hanging device. More particularly, the invention relates to a hanging device that has improved hanging and illumination functions.

2. Description of the Related Art

A conventional closet is usually provided with lighting and hanging devices. In most of the cases, the lighting is mounted on a ceiling of the closet. The hanging device is usually located between two sidewalls of the closet for hanging clothing or the like. A plurality of drawers may be further provided inside the closet. The light from the lighting of the ceiling in the closet is easily barred, resulting in insufficient illumination for a good visibility.

Taiwan Patent Application No. 90213540 is filed by the same applicant of the present application, and the disclosure thereof is incorporated herein by reference. The above-cited Taiwan Patent Application discloses a hanging device provided with a lighting thereon. FIG. 1 is an exploded view of a hanging device of the prior art. As shown in FIG. 1, a hanging device 20 includes a support member 201, two fixtures 203, two adjustment units 205, a hanging rod 207, and a fluorescent tube 208. The support member 201 is connected to an electrical wire 202. The fixture 203 has a hollow portion in the center thereof where the electrical wire can penetrate. A plurality of adjustment holes 204 are further formed on the fixtures 203. The adjustment units 205 are respectively provided with a slot 206 matching the adjustment holes 204 for fixing the above elements. The hanging rod 207 is connected to the two adjustment units 205 at both ends thereof. The fluorescent tube 208 is located inside the hanging rod 207, and the support member 201 is located super-adjacent to a top of the hanging rod 207. The support member 201 of the conventional hanging device 20, located outside the hanging rod 207, wastes the inner space of the closet. After arranging the support member 201 between the sidewalls of the closet or on the shelves of the closet, one end of each fixture 203 is fastened upon the shelves by infixing the fixtures 203 to the shelves so as to firmly mount the whole hanging device on the shelves.

The hanging rod 207 consists of an upper plate 2071 and a lower plate 2072, both of which are in a concave shape. There is nothing but the fluorescent tube 208 inside the hanging rod 207. If an excessive amount of clothes is hung on the hanging rod 207, the hanging rod 207 may break due to insufficient support. This may be dangerous because the fluorescent tube 208 may also break. Furthermore, the hanging device cannot provide further support for receiving additional elements such as hanging rods and internal power supplies.

SUMMARY OF THE INVENTION

It is therefore a principal object of the invention to provide a hanging device with internal lighting that is firmly mounted in the closet with a reduced occupation space. The hanging device of the invention is compact and has a reinforced structure, thereby taking into account both esthetic and practical aspects. Additionally, the hanging device also provides good illumination.

According to one aspect of the invention, the hanging device comprises a support member, two fixtures, two adjustment units and a hanging rod. The hanging rod includes a cover and a lampshade. A support base, which has a fluorescent tube mounted at a bottom thereof and the support member mounted at a top thereof, is located between the cover and the lampshade. Therefore, the support member does not occupy any external space out of the hanging rod, resulting in an esthetic and compact structure.

Each of the adjustment units includes a connection body and a vertical connector that is vertically connected to one end of the connection body. One connection body comprises a stationary lid and a slidable lid. Each end of the cover of the hanging rod 4 engages one stationary lid. The slidable lids of each connection body are detachably connected to each end of the lampshade. When the fluorescent tube is to be replaced, only the slidable lids are needed to outwardly slide for separating from the lampshade. Thereafter, the lampshade is pressed inward to detach the engagement slots of the lampshade from the engagement slots of the cover, so that the lampshade is easily separated from the hanging rod for replacing the fluorescent tube.

According to another aspect of the invention, more than one of the above hanging device can be electrically connected in series by providing each hanging device with a socket and an electric plug on ends thereof.

Still, according to another aspect of the present invention, an automatic sensor connected to the hanging device can be further provided in a closet where the hanging device is used. When the closet having the hanging device therein is opened, the sensor detects the opening and turns on the fluorescent tube of the hanging device.

Furthermore, according to another aspect of the invention, a reinforcement hook is further mounted at the middle of the hanging rod in order to support a longer fluorescent tube used in the hanging device. The reinforcement hook has its hook portion surround the extended hanging rod, leaving the top of the extended hanging rod for free sliding hangers.

BRIEF DESCRIPTION OF THE DRAWINGS

The drawings included herein provide a further understanding of the invention and, incorporated herein, constitute a part of the invention disclosure. A brief introduction of the drawings is as follows.

DESCRIPTION OF THE PREFERRED EMBODIMENTS

Figure 1:
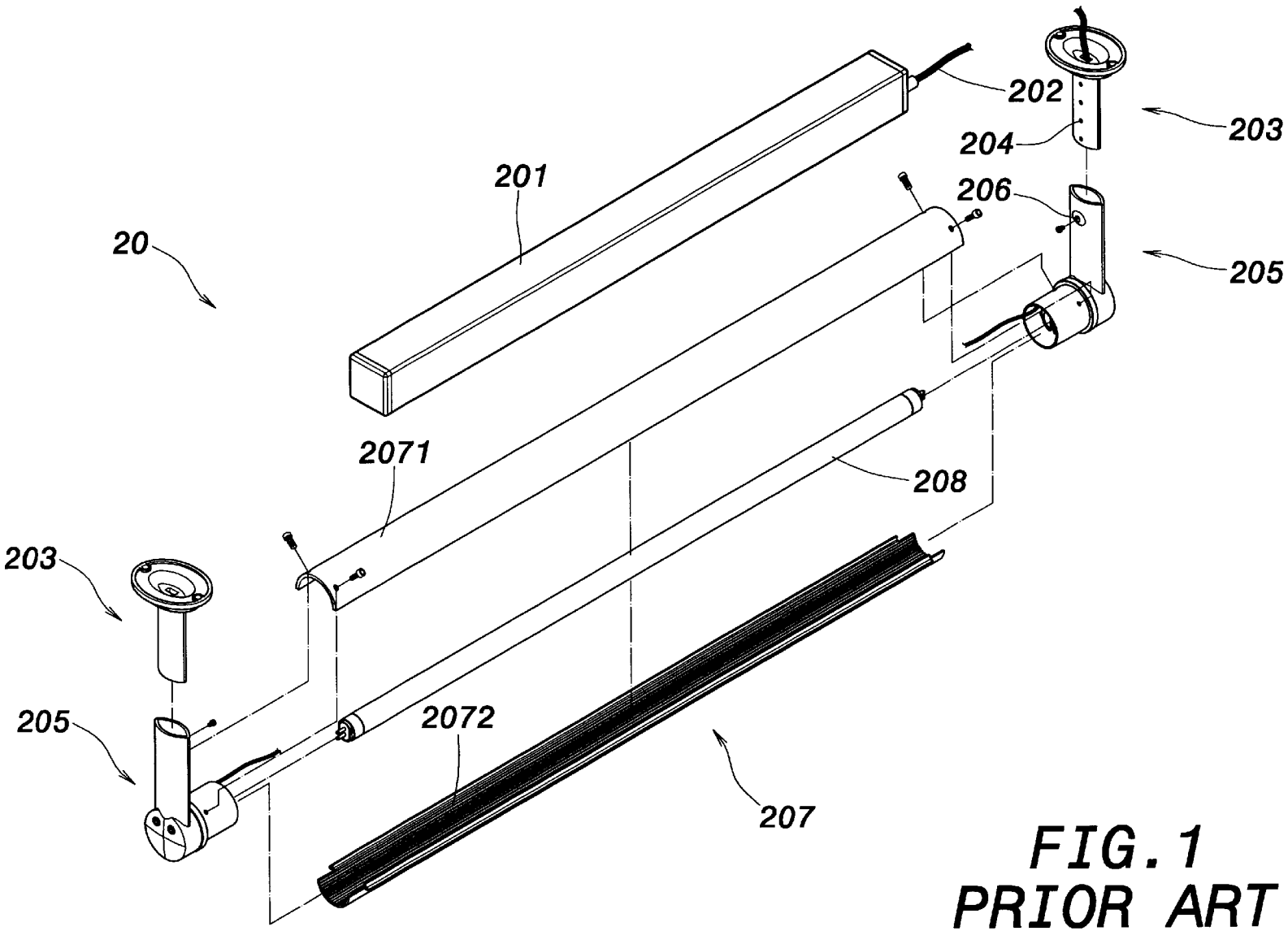
FIG. 1 PRIOR ART
FIG. 1 is an exploded view of a conventional hanging device.

The following detailed description of the invention with reference to the accompanying drawings is only illustrative of specific structures and ways of making the invention, and does not limit the scope of the invention. Wherever possible in the description, like reference numerals will refer to like elements and parts unless otherwise illustrated.

Figure 2:
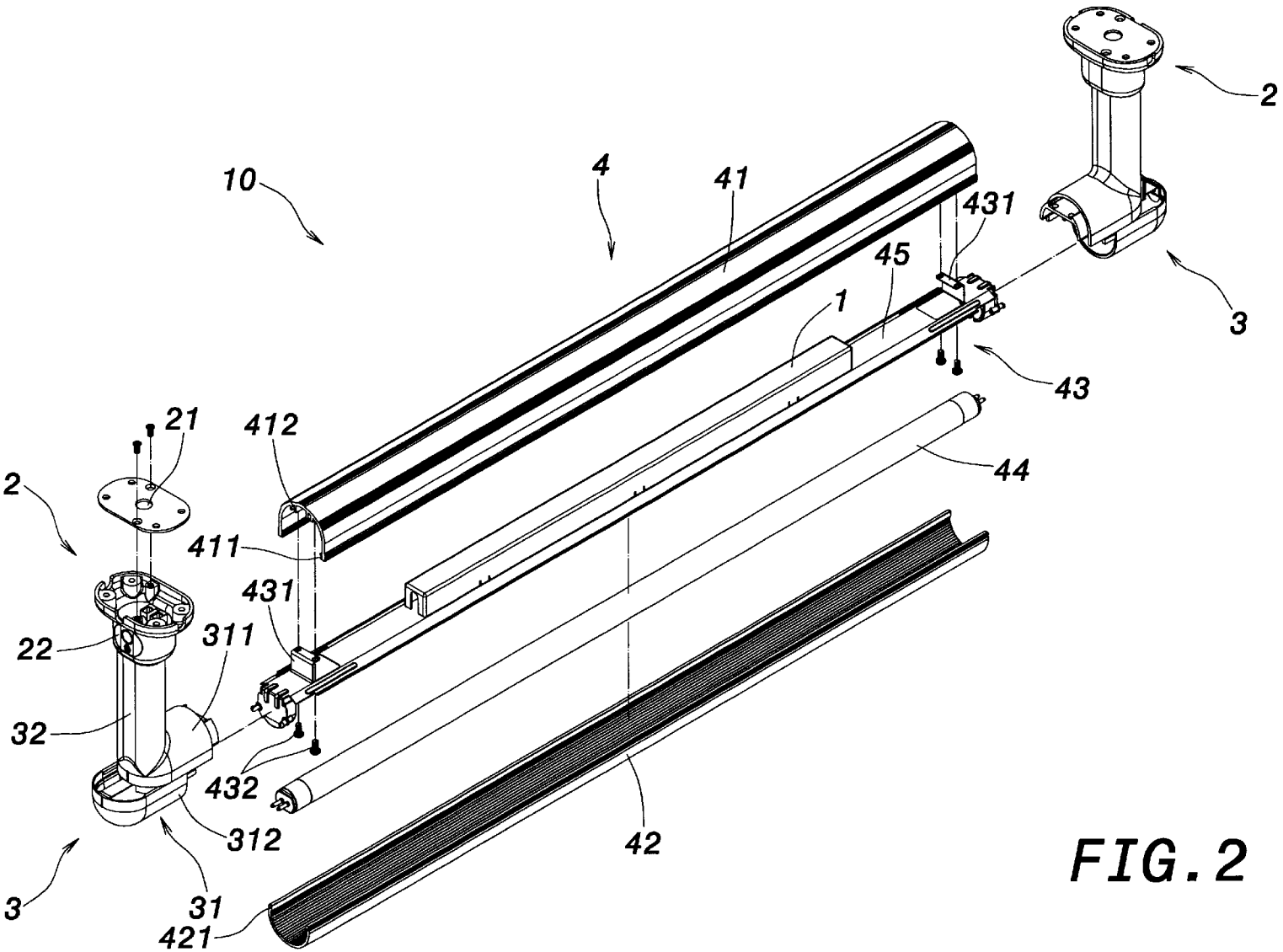
FIG. 2 is an exploded view of a hanging device according to a first embodiment of the invention.
Figure 3:
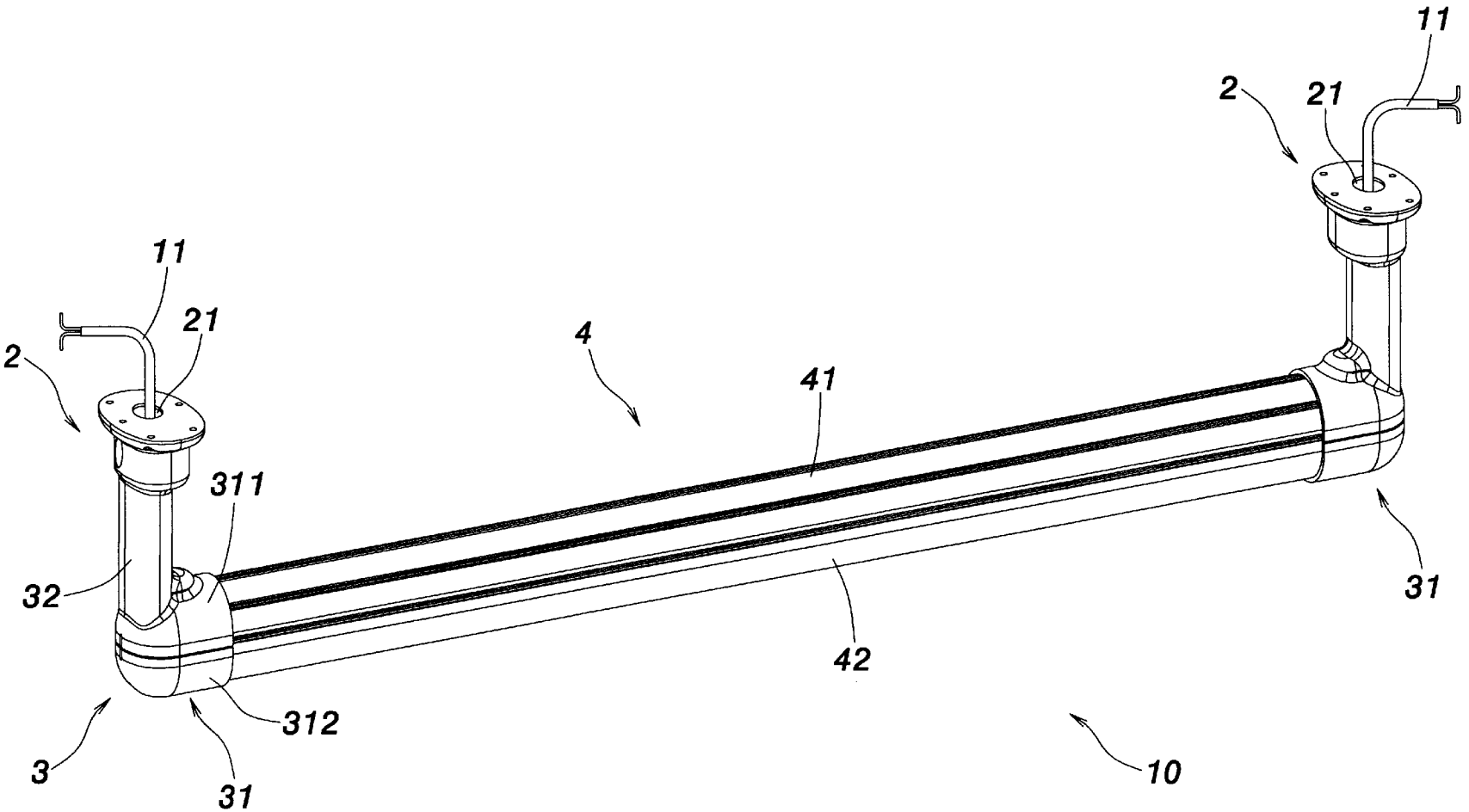
FIG. 3 is a schematic view showing a hanging device assembled according to the first embodiment of the invention.
Figure 4:
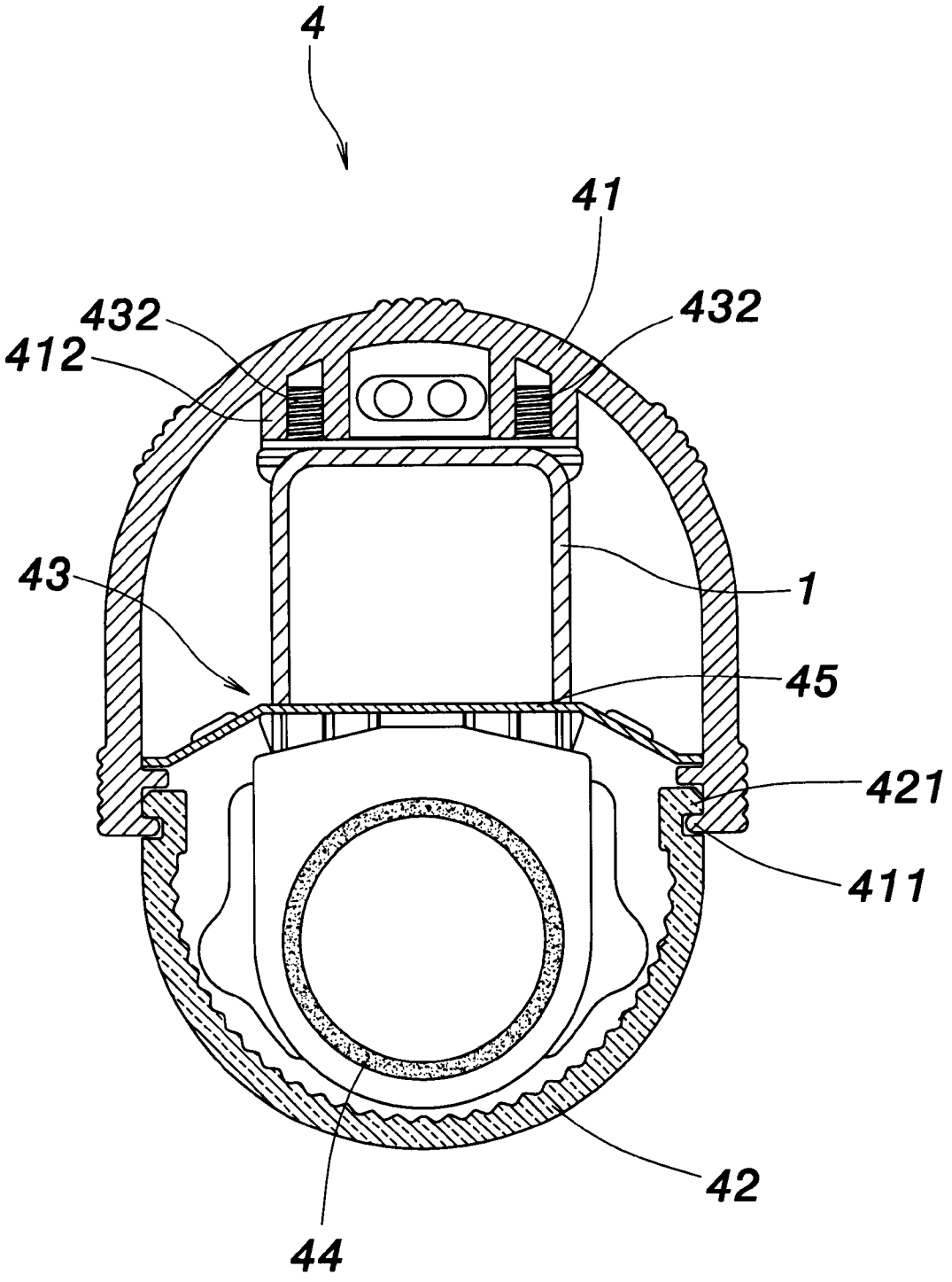
FIG. 4 is a cross sectional view of a hanging device according to the first embodiment of the invention.

FIG. 2 is an exploded view of a hanging device according to a first embodiment of the invention. FIG. 3 is a schematic view showing a hanging device assembled according to the first embodiment of the invention. FIG. 4 is a cross sectional view of a hanging device according to the first embodiment of the invention.

With reference to FIG. 2 through FIG. 4, a hanging device 10 of the invention comprises a support member 1, two fixtures 2, two adjustment units 3, and a hanging rod 4 with internal lighting. The hanging rod 4 includes a cover 41 and a lampshade 42. The cover 41 and the lampshade 42 engage with each other to form a substantially ellipsoidal shape. At the locations where the cover 41 and the lampshade 42 are engaged, engagement slots 411, 421 are formed in a shape of "⊂" for buckling the cover 41 and the lampshade 42. A support base 43 is assembled with the cover 41 via lateral sides of the support base 43 engaging the engagement slots 411 of the cover 41. The support base 43 is thereby firmly arranged in the hanging rod 4. Furthermore, a plurality of ribs 412 that are spaced apart from one another are formed in row on an inner wall of the cover 41 to reinforce the hanging device 10 and further increase thermal dissipation.

Figure 2A:
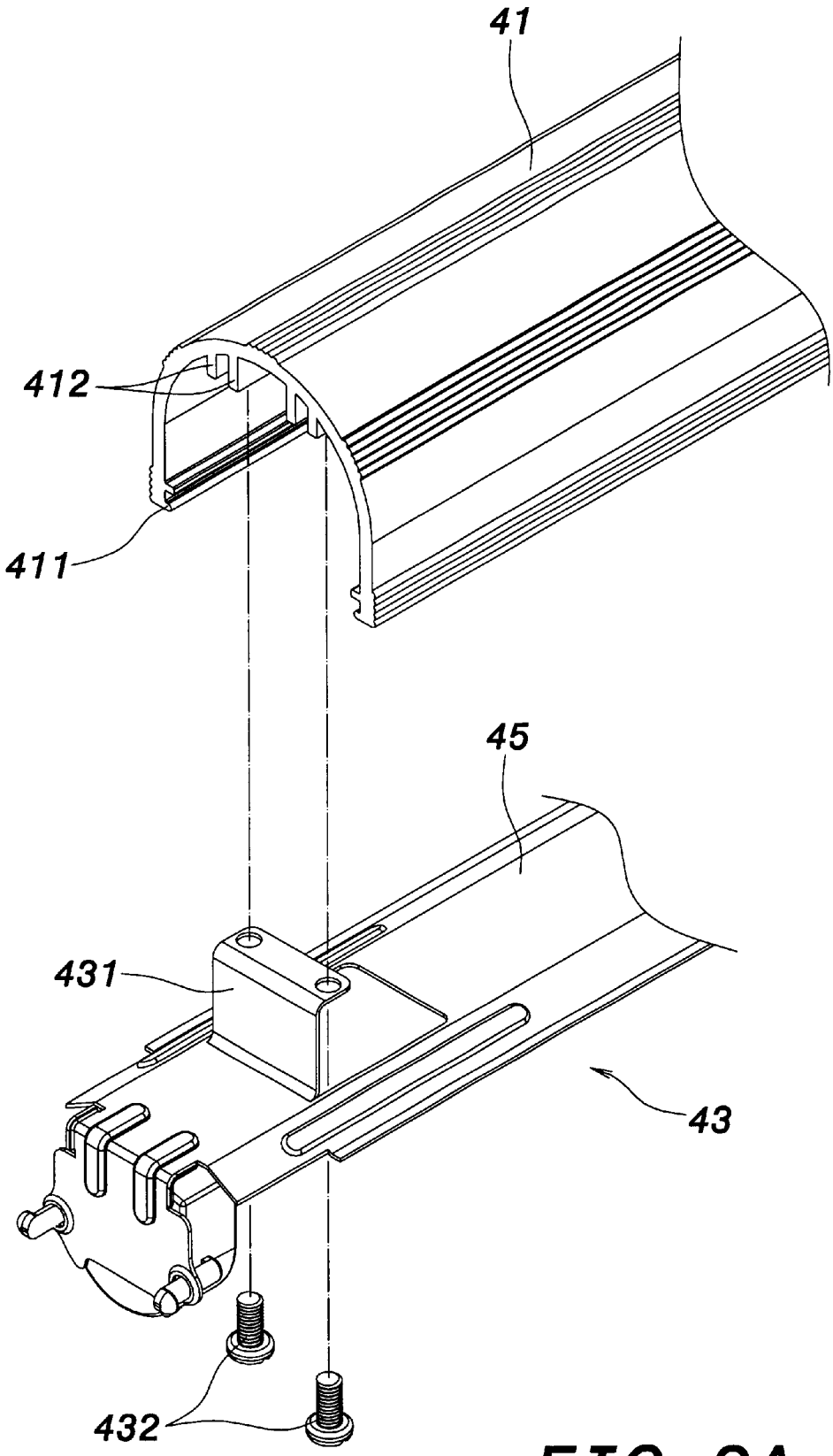
FIG. 2A is a partially enlarged view of FIG. 2.

Lighting such as a fluorescent tube is located underneath the support base 43, with the support member 1 being superimposed on the support base 43. In other words, both the support member 1 and the fluorescent tube are inside the hanging rod 4. The support member 1 can be, for example, an electronic stabilizer. FIG. 2A is a partially enlarged view of FIG. 2. One L-shaped portion 431 is formed near each end of the support base 43 to enable a screw 432 to be guided into a space between the ribs 412, thereby fixing the support base 43.

The support base 43 can be further polished to have a reflective surface 45 for increasing the illumination of the fluorescent tube 44. The reflective surface 45 can have a curved shape, and further be flexible.

In FIG. 3, the hanging rod 4 is connected to two adjustment units 3. One end of each adjustment unit 3 is connected to the hanging rod 4, and the other end is pivoted on a fixture 2 that fixes the hanging device 10 to a shelf. The distance between the adjustment unit 3 and the fixture 2 can be varied as desired. The adjustment of the distance between the adjustment unit 3 and the fixture 2 is disclosed in another application filed by the same applicant.

Each of the adjustment units 3 includes a connection body 31 and a vertical connector 32 that is vertically connected to one end of the connection body 31. The vertical connector 32 is pivotally connected to the fixture 2. The connection body 31 consists of a stationary lid 311 and a slidable lid 312. Each end of the cover 41 of the hanging rod 4 is engaged with one stationary lid 311. The slidable lid 312 is detachably connected to each end of the lampshade 42.

When assembled, the fluorescent tube 44 is mounted underneath the support base 43, and the support member 1 is superimposed upon the support base 43, the fluorescent tube 44 and the support member 1 being between the cover 41 and the lampshade 42. The cover 41 and the lampshade 42 are engaged with each other through the engagement slots 411, 421 to achieve the hanging rod 4. The adjustment units 3 together with the fixtures 2 are mounted to the ends of the hanging rod 4 so that the stationary lid 311 is engaged to the cover 41 and the slidable lid 312 is detachably connected to the lampshade 42. The support member 1 is provided with a power wire 11 that extends from an opening 21 defined at a top of the fixture 2 for external electrical connection. Therefore, a hanging device 10 is accomplished, as shown in FIG. 3.

Figure 5:
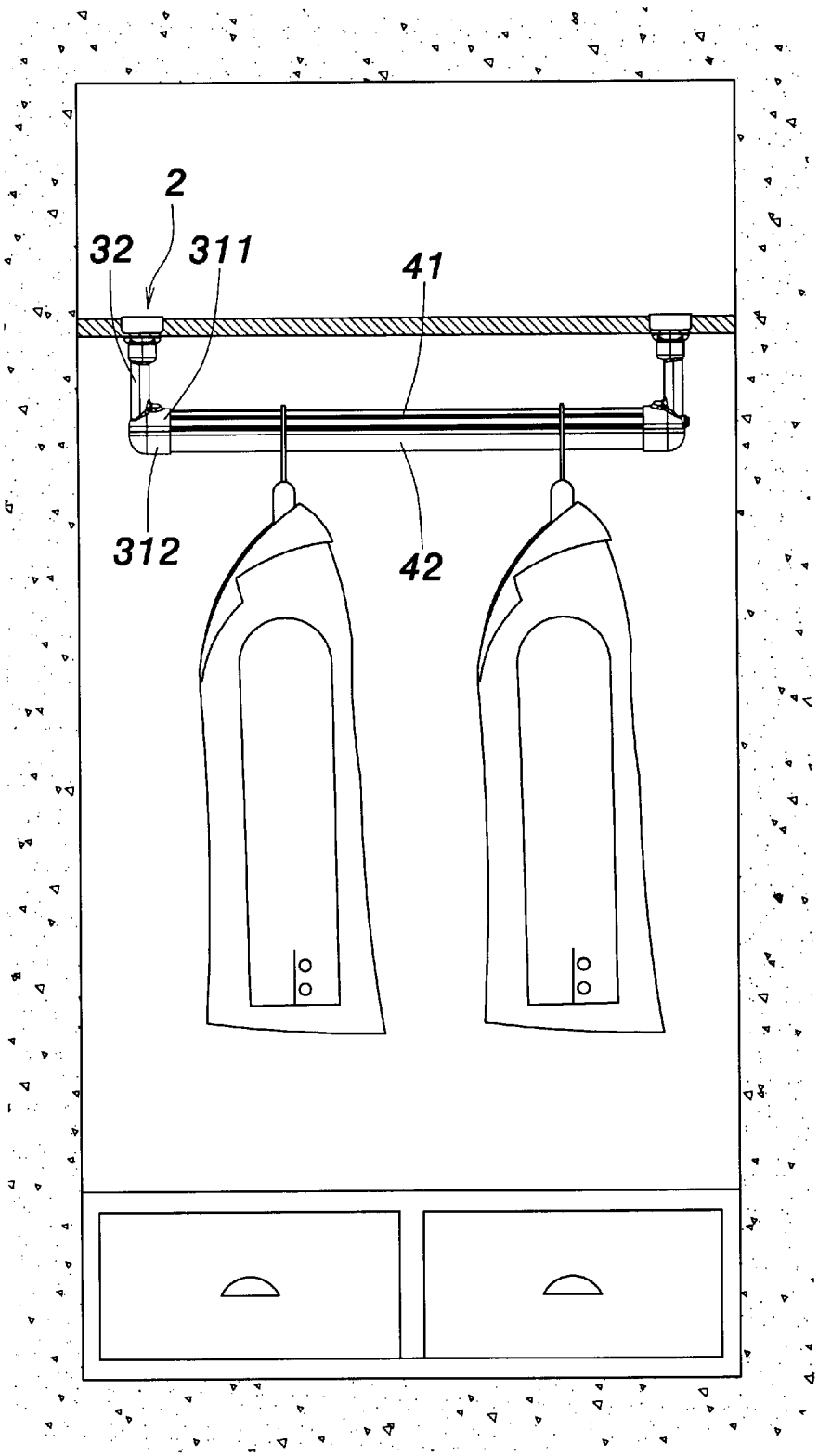
FIG. 5 is a schematic view of a hanging device in use according to the first embodiment of the invention.

FIG. 5 is a schematic view of a hanging device in use according to the first embodiment of the invention. In use configuration, the fixture 2 is fixed to the shelf, as shown in FIG. 5. Clothing is hung on the hanging rod 4 provided with the support member 1 therein. The hanging rod 4 is reinforced by means of the rib 412 as well as the engagement slots 411, 421 that also serve as reinforcement elements. Additionally, the fluorescent tube 44 inside the hanging rod 4 provides good illumination.

Figure 6:
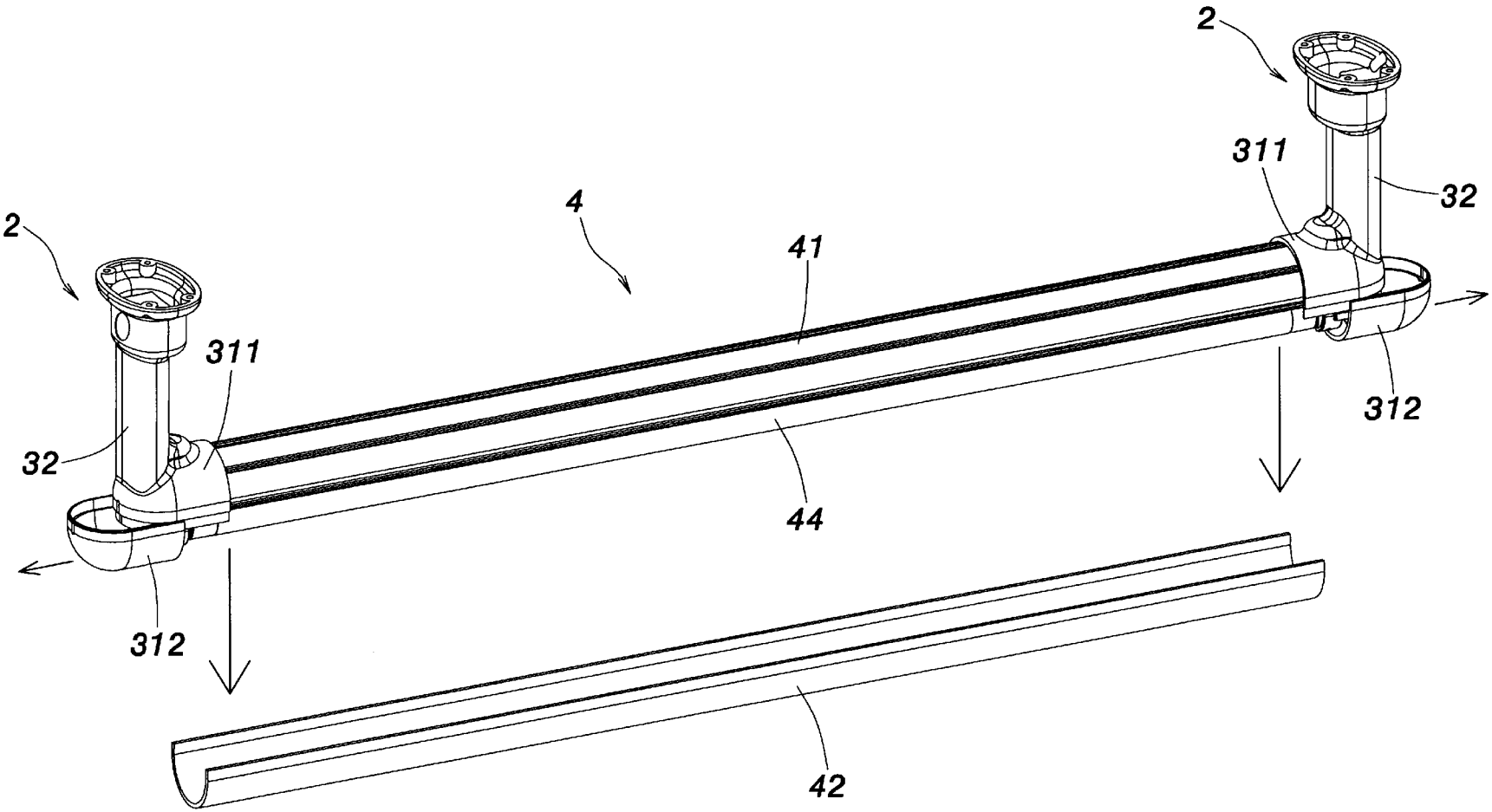
FIG. 6 is a view showing the replacement of a fluorescent tube according to the first embodiment of the invention.

FIG. 6 is a view showing a replacement of a fluorescent tube according to the first embodiment of the invention. When the fluorescent tube 44 is to be replaced, only the slidable lid 312 is needed to slide outward to separate from the lampshade 44. Thereafter, the lampshade 44 is pressed inward to detach the engagement slots 421 of the lampshade 42 from the engagement slots 411 of the cover 41, the lampshade 42 is thereby easily separated from the hanging rod 4 for replacing the fluorescent tube 44.

Figure 7:
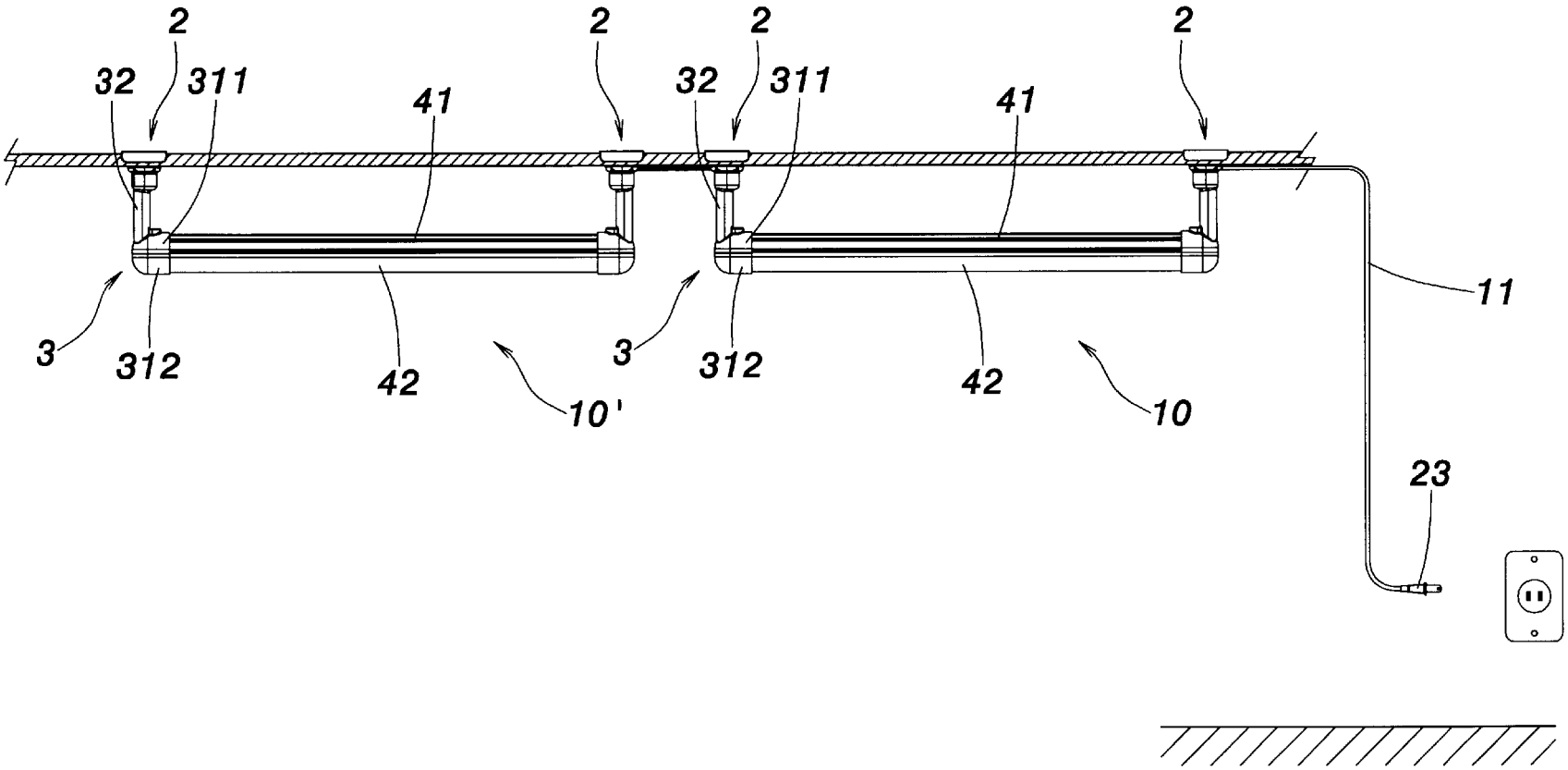
FIG. 7 is a schematic view of a hanging device according to a second embodiment of the invention.

FIG. 7 is a schematic view of a hanging device according to a second embodiment of the invention. In FIG. 7, two hanging devices 10, 10' similar to those shown in FIG. 2 through FIG. 4 are electrically connected in series. A socket 22 as shown in FIG. 2 is provided at a right end of each of the hanging devices 10, 10', and an electric plug as shown in FIG. 2 is provided at a left end of each of the hanging devices 10, 10'. The electrical plug 23 of the hanging device 10' is inserted into the socket 22 of the hanging device 10 without the power wire 11. More than two hanging devices can be connected in the manner described above, avoiding the exposure of any power wire.

Figure 8:
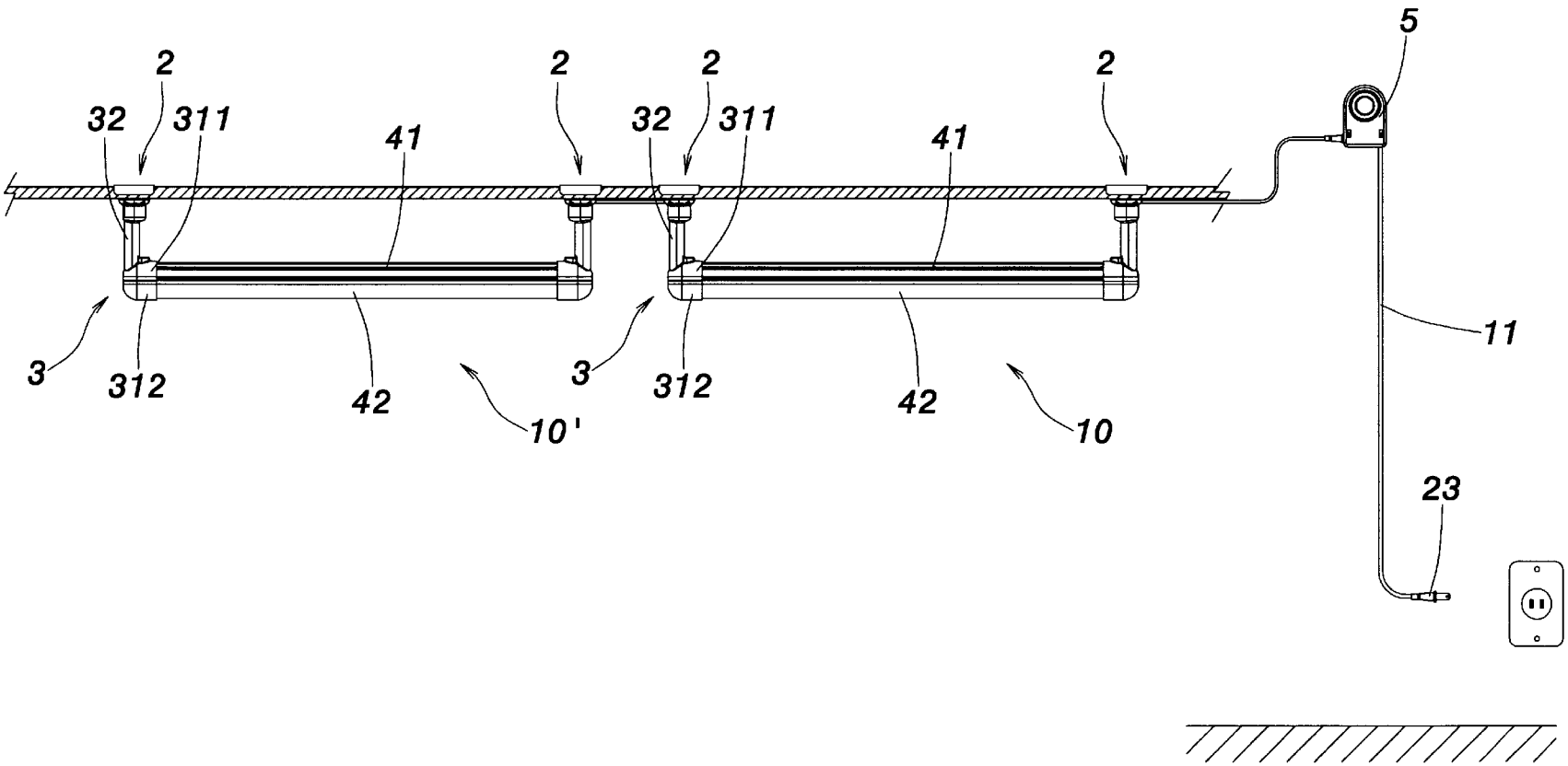
FIG. 8 is schematic view of a hanging device according to a third embodiment of the invention.

FIG. 8 is schematic view of a hanging device according to a third embodiment of the invention. An automatic sensor 5 connected to the hanging device 10 can be further provided in the closet. In FIG. 8, the automatic sensor 5 is located on the power wire 11 extended from the fixtures 2. The sensor 5 detects whether the closet is opened, and consequently turns on the fluorescent tube of the hanging device 10 if the closet is opened.

Figure 9:
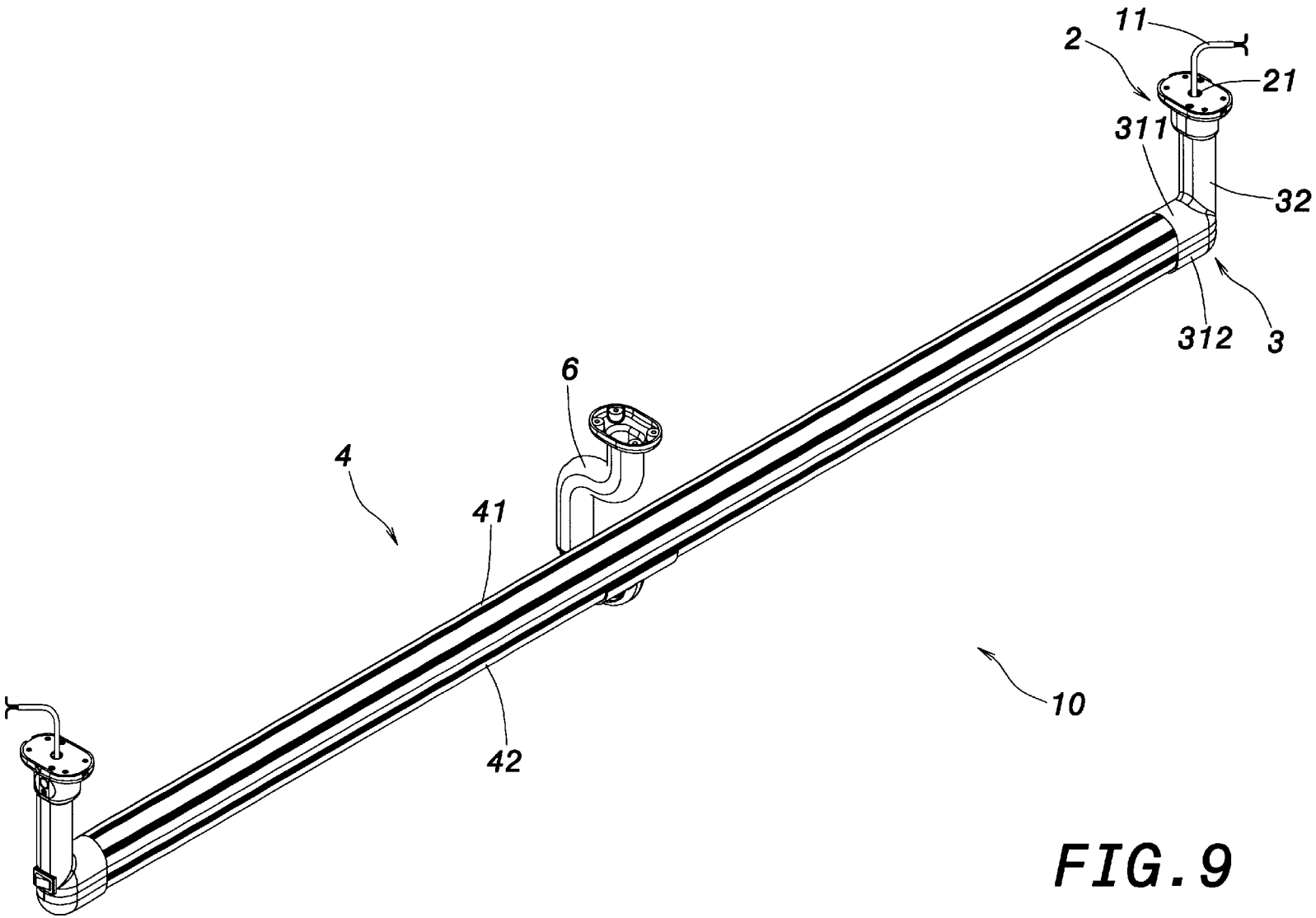
FIG. 9 is a schematic view of a hanging device according to a fourth embodiment of the invention.

FIG. 9 is a schematic view of a hanging device according to a fourth embodiment of the invention. When a longer fluorescent tube 44 is installed in the hanging device, a reinforcement hook 6 is further mounted at the middle of the hanging rod 4 to support the longer fluorescent tube 44. If the fluorescent tube 44 is not more than 2 m, the additional reinforcement hook 6 is not required. However, if the fluorescent tube 44 is about 4 m as shown in FIG. 9, an extended hanging rod 4 is required and the reinforcement hook 6 is thus needed. The reinforcement hook 6 has its hook portion surround the extended hanging rod 4, leaving the top of the extended hanging rod 4 for free sliding hangers.

Figure 10:
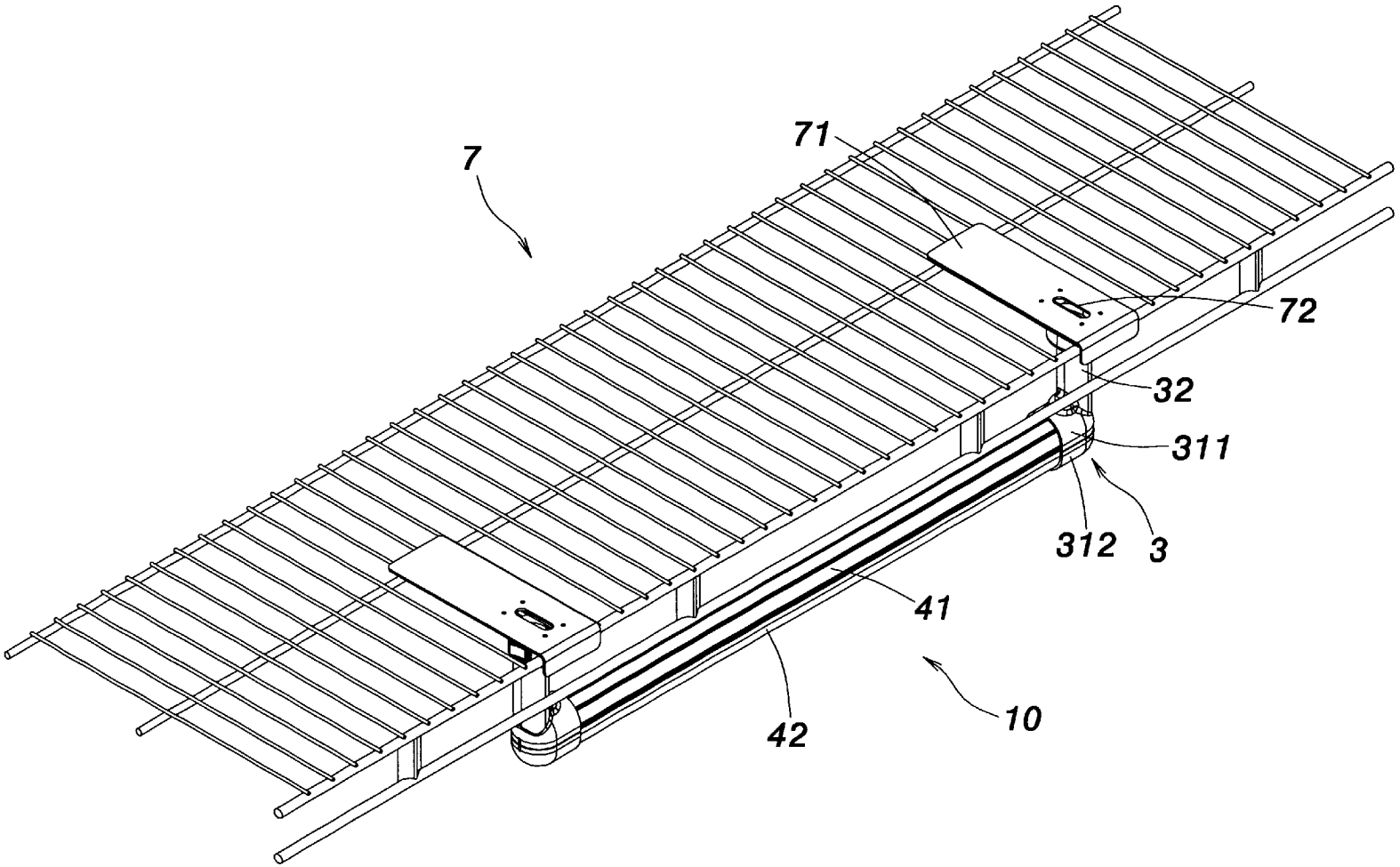
FIG. 10 is a schematic view of a hanging device according to a fifth embodiment of the invention.

FIG. 10 is a schematic view of a hanging device according to a fifth embodiment of the invention. The hanging device 10 is mounted on a rack 7. A pin 71 is used to fix the fixture 2 to the rack 7. The pin 71 has a slot 72 through which a location of the hanging device 10 on the rack 7 can be adjusted.

Figure 11:
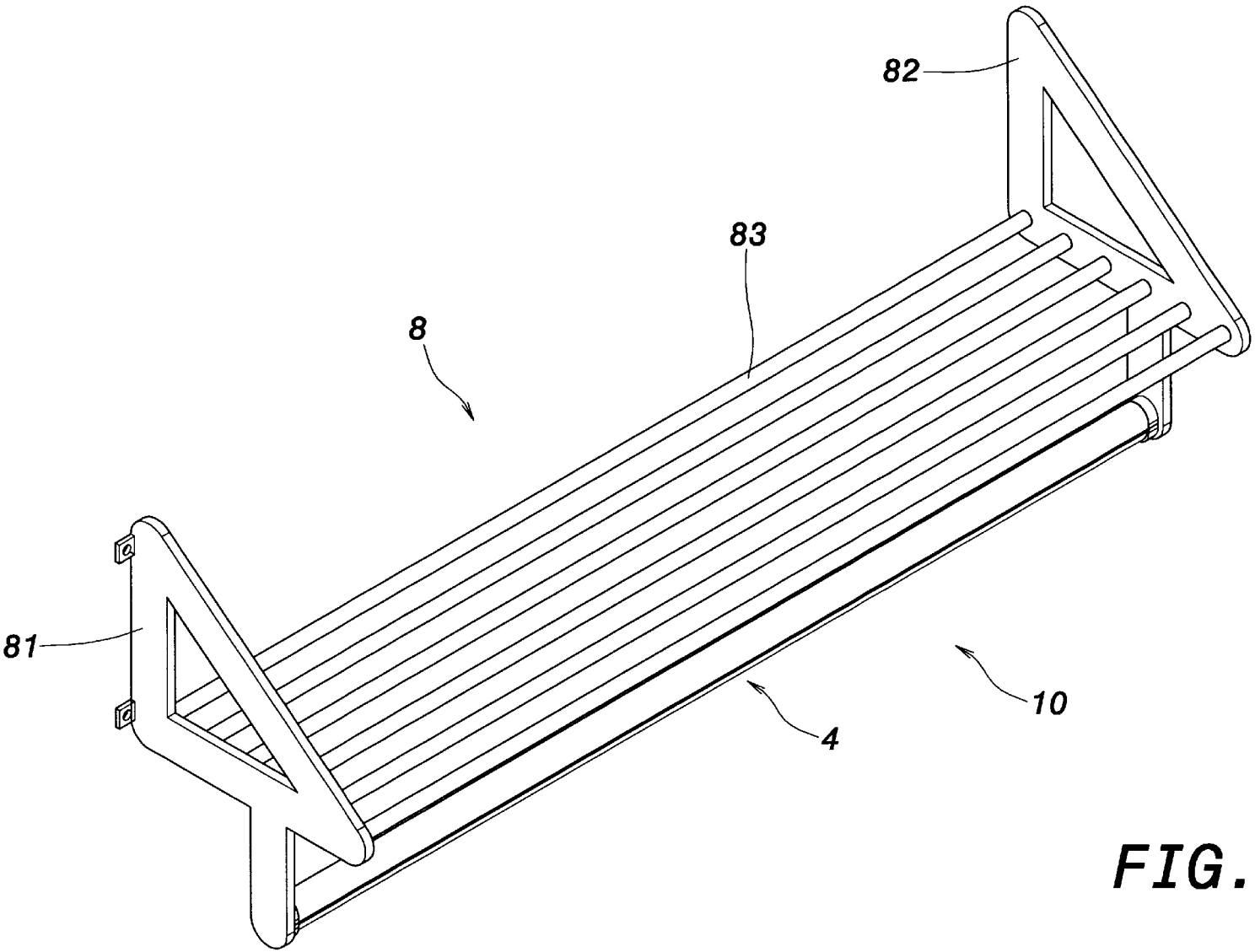
FIG. 11 is a schematic view of a hanging device according to a sixth embodiment of the invention.

FIG. 11 is a schematic view of a hanging device according to a sixth embodiment of the invention. The hanging device 10 is integrally formed with a rack 8. The rack 8 has a plurality of stems 83 arranged in parallel. At ends of the rack 8 are respectively formed a left plate 81 and a right plate 82 that are integrally connected with the ends of the hanging device 10.

Figure 12:
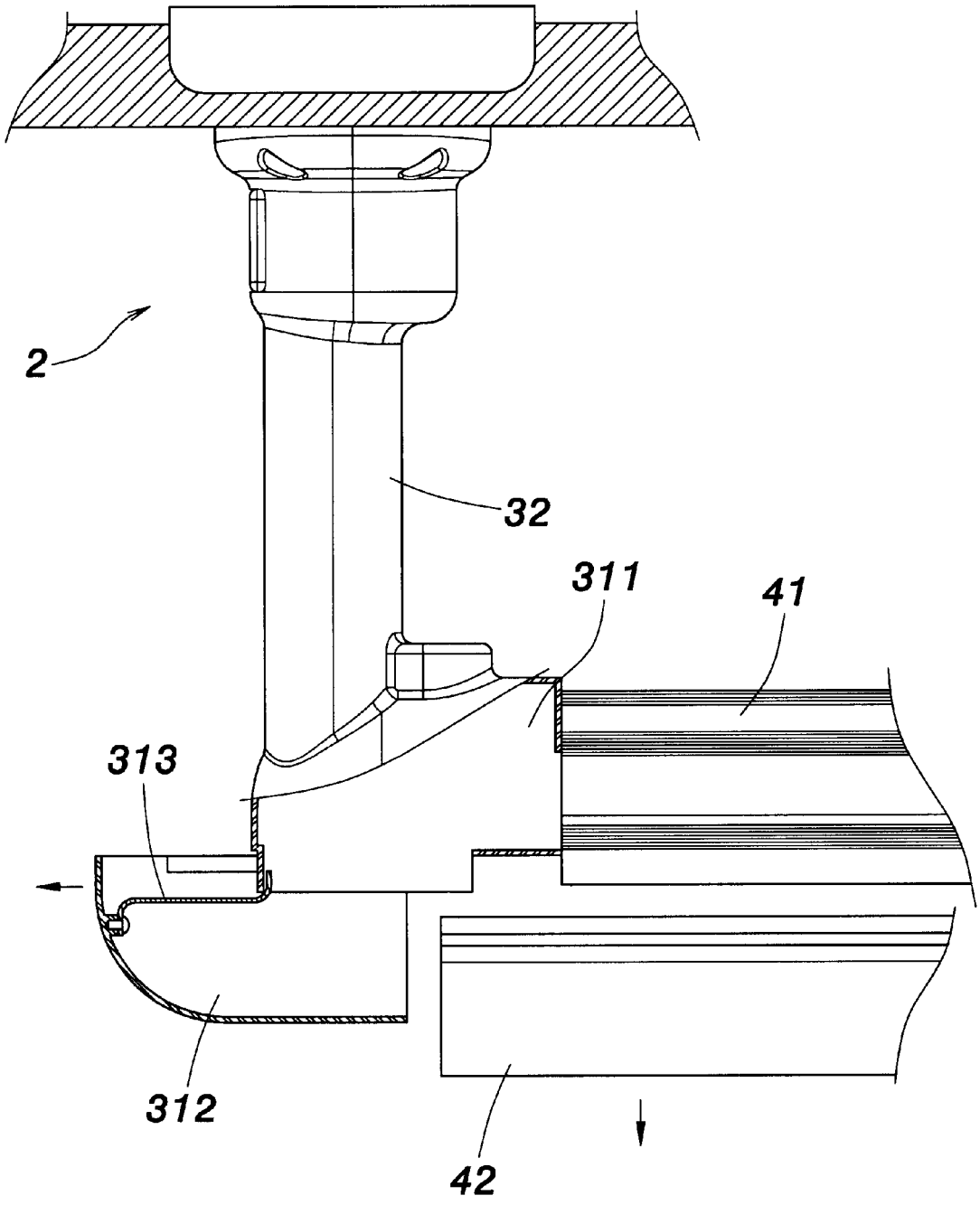
FIG. 12 a cross-sectional view showing a connection body of the invention.

FIG. 12 is a cross-sectional view showing a connection body of the invention. When the slidable cover 312 slides outward for replacing the fluorescent tube 44 in the hanging rod 4, an engagement support member 313 is further arranged for preventing the fluorescent tube 44 from dropping. The engagement support member 313 is fixed in the slidable lid 312 at one end thereof, and is further located inside the stationary lid 311 at the other end. Once the slidable lid 312 is pulled outward to open the adjustment unit 3, the engagement support member 313 located inside the stationary lid 311 is immediately engaged with the stationary lid 311 to stop the slidable lid 312 from being further outwardly pulled.

In view of the foregoing, the hanging device 10 of the invention is compact and has a reinforced structure, which is esthetic and practical. Additionally, the hanging device 10 also provides good illumination.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A hanging device with internal lighting, comprising a support member;

two fixtures;

a hanging rod having a cover, lampshade, a support base located between the cover and the lampshade, a fluorescent tube placed on a bottom of the support base, and a support member placed on a top thereof, an L-shaped portion being formed near each end of the support base to thereby enable a screw to be guided in a space between the ribs through the L-shaped portion for fixing the support base, an inner wall of the cover being provided with a plurality of elongate ribs; and, two adjustment units each having a connection body and a vertical connector, the vertical connector being vertically connected to the connection body at one end and pivotally connected to at least one of the fixtures, the connection body further comprising a stationary lid engaging with the cover of the hanging rod, and a slidable lid engaging with the lampshade of the hanging rod.

2. The device of claim 1, wherein the cover is engaged with the lampshade to form a substantially ellipsoidal shape, thereby making the inner space larger.

3. The device of claim 1, wherein cover and the lampshade are engaged with each other by engagement slots.

4. The device of claim 1, wherein the support base has a reflective surface at the bottom thereof where the fluorescent tube is mounted.

5. The device of claim 1, wherein one of the fixtures located at one end of the hanging rod is provided with a socket, and the other fixture located at the other end of the hanging rod is provided with an electrical plug, thereby more than one of the hanging devices being electrically connected in series.

6. The device of claim 1, wherein an automatic sensor is further provided and connected to the hanging rod.

7. The device of claim 1, wherein a reinforcement hook is further provided at the middle of the hanging rod when the hanging rod is extended.

8. A hanging device with internal lighting comprising:

a support member;

two fixtures;

a hanging rod, comprising a cover and lampshade, wherein a support base, which has a fluorescent tube placed on a bottom thereof and a support member placed on a top thereof, is located between the cover and the lampshade, the hanging rod is being mounted on a rack via a pin where a slot is defined for adjusting a location of the hanging device on the rack; and, two adjustment units each comprising a connection body and a vertical connector, the vertical connector being vertically connected to the connection body at one end and pivotally connected to the fixture, the connection body further comprising a stationary lid engaging with the cover of the hanging rod, and a slidable lid engaging with the lampshade of the hanging rod.

9. The device of claim 1, wherein the hanging rod is integrally formed with a rack having a plurality of stems in parallel, and wherein at ends of the rack are respectively formed a left plate and a right plate which are integrally connected with the ends of the hanging device.

10. A hanging device with internal lighting comprising:

a support member;

two fixtures;

a hanging rod, comprising a cover and lampshade, wherein a support base, which has a fluorescent tube placed on a bottom thereof and a support member placed on a top thereof, is located between the cover and the lampshade;

two adjustment units each comprising a connection body and a vertical connector, the vertical connector being vertically connected to the connection body at one end and pivotally connected to the fixture, the connection body further comprising a stationary lid engaging with the cover of the hanging rod, and a slidable lid engaging with the lampshade of the hanging rod;

the cover having an engagement member one end of which is fixed in the slidable lid and the other end is located inside the stationary lid.

* * * * *